US006382850B1

(12) United States Patent
Freund et al.

(10) Patent No.: US 6,382,850 B1
(45) Date of Patent: May 7, 2002

(54) INK JET PRINTER FOR PHOTOFINISHING

(75) Inventors: Michael N. Freund, Adelberg; Alexander Hirsch, Stuttgart, both of (DE)

(73) Assignee: Eastman Kodak Company, Rochester, NY (US)

( * ) Notice: Subject to any disclaimer, the term of this patent is extended or adjusted under 35 U.S.C. 154(b) by 124 days.

(21) Appl. No.: 09/596,933

(22) Filed: Jun. 19, 2000

(30) Foreign Application Priority Data

Jun. 25, 1999 (DE) ..... 199 29 322

(51) Int. Cl.[7] ..... B41J 2/00

(52) U.S. Cl. ..... 400/118.2; 400/76; 400/61; 400/70

(58) Field of Search ..... 400/118.2, 61, 400/70, 76

(56) References Cited

U.S. PATENT DOCUMENTS 5,812,162 A 9/1998 Silverbrook

FOREIGN PATENT DOCUMENTS

| | | | |
|---|---|---|---|
| DE | WO 99/08878 | * | 2/1999 |
| DE | 197 35 070 A | | 2/1999 |
| EP | 0 710 561 A2 | | 5/1996 |
| EP | 0 887 196 A2 | | 12/1996 |
| GB | 2142579 A | * | 1/1985 |
| JP | 59 209147 A | | 11/1984 |
| WO | WO 97/28003 | | 1/1997 |

* cited by examiner

*Primary Examiner*—John S. Hilten
*Assistant Examiner*—Charles H. Nolan, Jr.
(74) *Attorney, Agent, or Firm*—Milton S. Sales

(57) ABSTRACT

An ink jet printer for making photographic prints includes at least one paper supply for holding a supply of print paper and a sheet paper transport belt arranged to receive sheets of print paper from the at least one paper supply and transport the sheets through the printer. A back printer is located between the paper supply and the paper transport belt for applying back prints to the print paper. A full print width color ink jet print head is located over a first portion of the transport belt for printing an image on a paper sheet. A paper support located under the ink jet print head is provided with ink overspill collection grooves to collect overspilled ink from the ink jet print head. A linear image sensor located in front of the ink jet print head detects the leading edge of the paper sheet being transported under the print head and a controller connected to the paper control the print head to print an image that is slightly wider and shorter than the paper, thereby preventing overspill printing on the leading and trailing edges of the sheet, while allowing slight overspill printing on the sides of the sheet into the overspill collection grooves. A paper dryer is located over a second portion of the vacuum belt transport; the paper dryer includes a source of flowing air for drying the image on the paper. A sheet trimming station is located at the end of the vacuum belt sheet transport for trimming the leading and trailing edges of a sheet after drying.

13 Claims, 8 Drawing Sheets

INK JET PRINTER FOR PHOTOFINISHING

FIELD OF THE INVENTION

The present invention relates to ink jet printers, and more particularly to an ink jet printer for use in printing digital photographic images.

BACKGROUND OF THE INVENTION

Digital photographic images provide significant advantages over conventional photographic images in that they can be manipulated, stored, retrieved, and transmitted using digital computer and data communication technology. Digital photographic images can be generated either by scanning photographic images captured on conventional photographic film, or directly by digital cameras employing solid state image sensors. Hard copy display prints of digital color photographic images are presently produced using thermal printers, electrographic printers, scanners for exposing conventional silver halide photographic paper, and ink jet printers.

The largest share of consumer photographic images are currently produced using optical printers on photographic paper. It has been realized however that consumer photofinishing would benefit from the advantages of digital image processing, since the digital images can be digitally processed for better correction of color balance and exposure, and can be digitally manipulated to add text or special effects and can be combined with other images. The images captured on silver halide photographic film are scanned to create color digital images, the color digital images are processed to correct color balance and exposure, and then printed using a color digital printer. Presently, the only digital printers for consumer photofinishing that are available on the market are of the type that use a scanning light beam to expose conventional silver halide photographic paper. Such digital printers still use wet chemical processing to develop the exposed photographic paper. Handling and disposal of the photo processing chemicals is costly and takes up space, which also must be paid for, for example in the form of rent. There is a need therefore for a digital photofinishing printer that avoids the problems and costs associated with wet chemical photographic paper processing.

Of the competing technologies, thermal printing, electrography and ink jet printing; thermal printing is limited by printing speed and cost of materials, and electrography is limited by equipment cost and complexity. It appears therefore that ink jet printing technology may be the best candidate to offer an improvement over scanned silver halide printers for digital consumer photofinishing.

It is well known to employ ink jet printers to produce hard copy prints of digital photographic images. Lower resolution images are produced on desk top ink jet color printers having resolution in the range of 300 to 1200 dpi. Large format color images are produced using graphic arts ink jet printers, see for example, published European Patent Application EP 0 710 561 A2, published Aug. 5, 1996, entitled Printer and Ink Cartridge to be Employed in Same, by Ikkatai; and published PCT application WO 97/28003, published Aug. 7, 1997, entitled Heated Inkjet Print Media Support System, by Rasmussen et al. Although high resolution color ink jet printing is likely to become a preferred mode for photofinishing, existing ink jet printers are severely limited by their speed of throughput. There is a need therefore for a high throughput, high resolution ink jet printer for photofinishing.

SUMMARY OF THE INVENTION

An ink jet printer for making photographic prints includes at least one paper supply for holding a supply of print paper and a sheet paper transport belt arranged to receive sheets of print paper from the paper supply and transport the sheets through the printer. A back printer is located between the paper supply and the paper transport belt for applying back prints to the print paper. A full print width color ink jet print head is located over a first portion of the transport belt for printing an image on a paper sheet. A paper support located under the ink jet print head is provided with ink overspill collection grooves to collect overspilled ink from the ink jet print head. An image sensor located in front of the ink jet print head detects the leading edge of the paper sheet being transported under the print head and a controller connected to the image controls the print head to print an image that is slightly wider and shorter than the paper, thereby preventing overspill printing on the leading and trailing edges of the sheet, while allowing slight overspill printing on the sides of the sheet into the overspill collection grooves. A paper dryer is located over a second portion of the vacuum belt transport, the paper dryer includes a source of flowing air for drying the image on the paper. A sheet trimming station is located at the end of the vacuum belt sheet transport for trimming the leading and trailing edges of a sheet after drying.

ADVANTAGES

The ink jet printer according to the present invention has the following advantages. Shrinkage of the printing paper in the drying section has no influence on the print area. Perfect borderless prints can be produced. The printing rate is compatible with the needs of commercial photofinishing operations.

BRIEF DESCRIPTION OF THE DRAWINGS

The invention is described with reference to the following drawings, where similar parts have been given similar numbers.

DETAILED DESCRIPTION OF THE INVENTION

Figure 1:
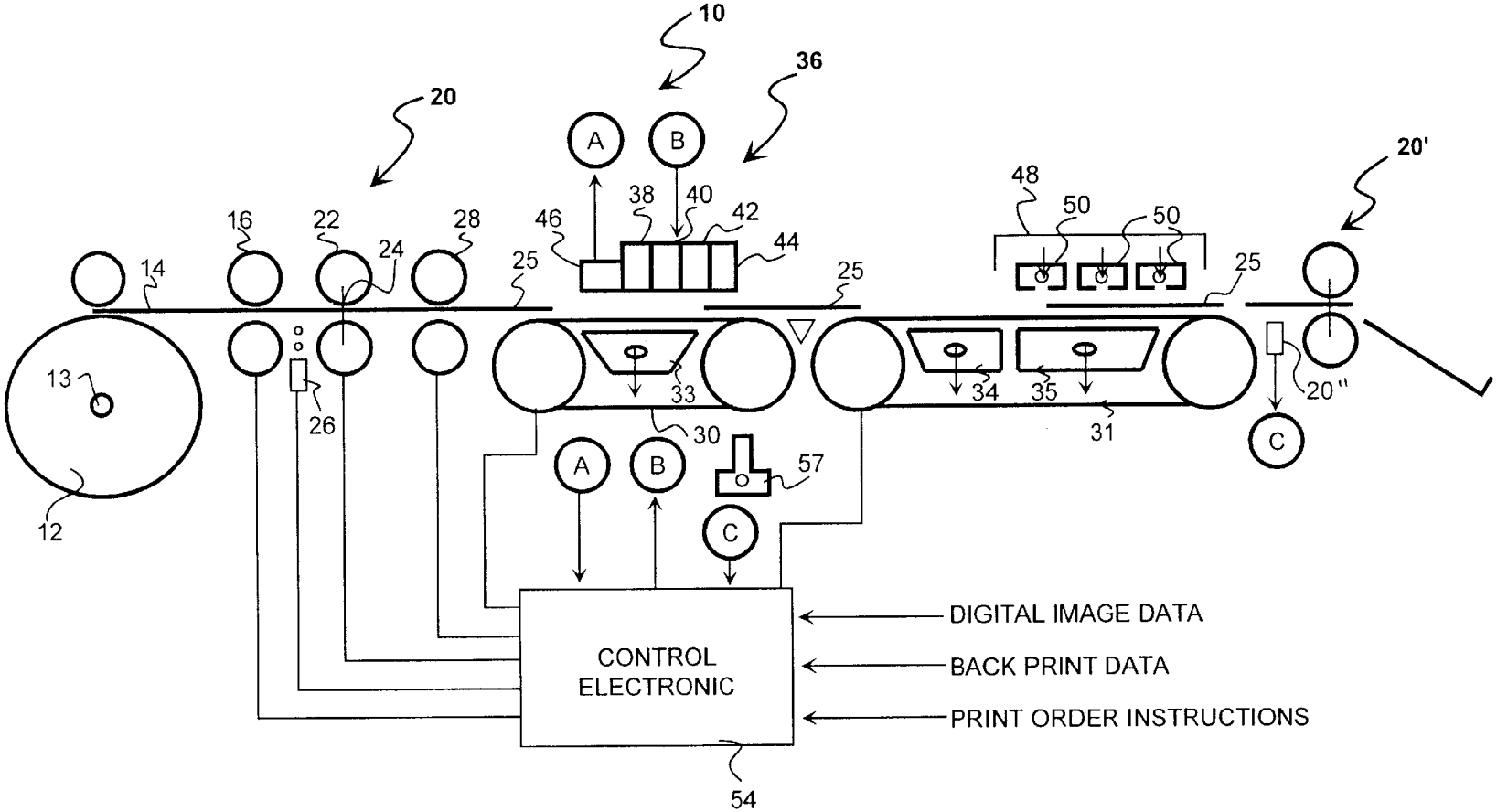
FIG. 1 is a schematic diagram of ink jet printer for making photographic prints according to the present invention.

Referring to FIG. 1, an ink jet printer, generally designated 10, for printing photographic images according to the present invention includes a roll paper supply 12, for supplying a web 14 of photographic ink jet print paper. The photographic ink jet print paper comprises for example, 200 to 300 gram/$M^2$ weight, 10 cm wide white paper having a special surface treatment for receiving ink from the ink jet printer as is known in the art. The web of paper 14 is supplied to a first pair of driven metering rollers 16.

Figure 4:
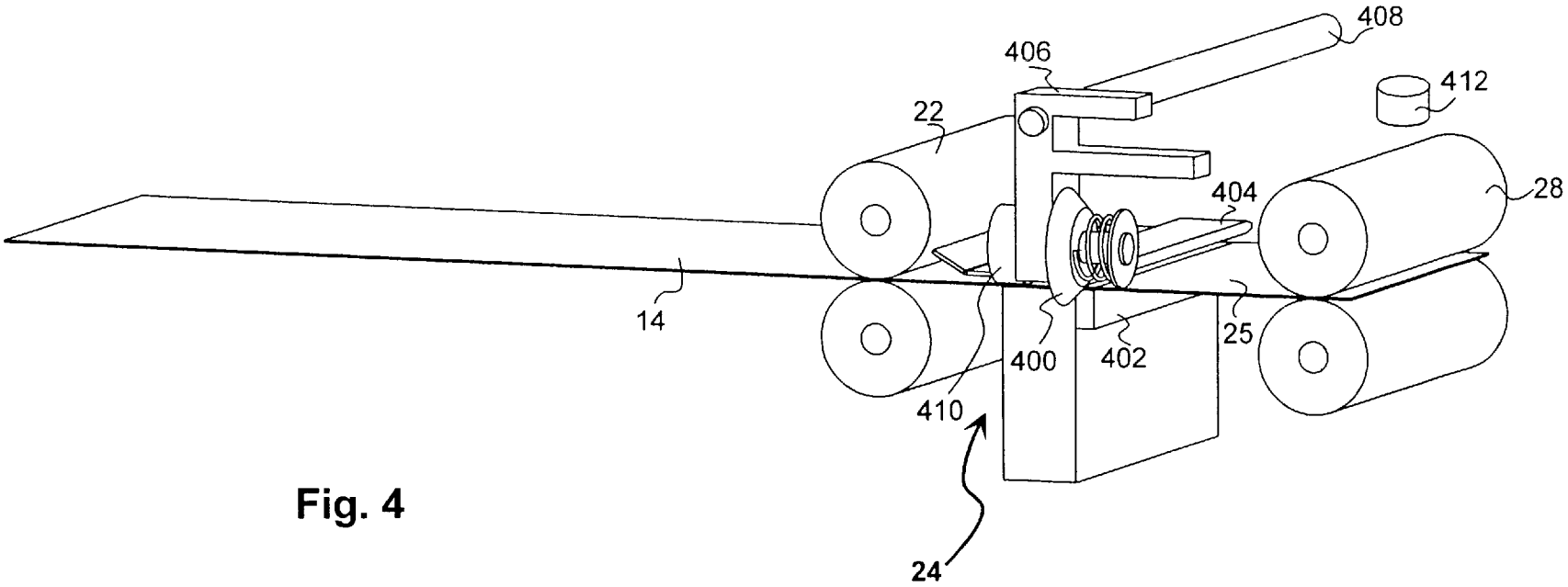
FIG. 4 is a schematic diagram showing the paper cutter employed in the ink jet printer according to the present invention.

A cut station 20 includes metering rollers 22 and a cutter 24. Referring to FIG. 4, the cutter 24 includes a circular knife 400 that is moved across the paper path against a fixed blade 402. The paper is held in a fixed position by a paper holder 404. The circular knife 400 is mounted on a knife carriage 406, which is supported for sliding movement on a shaft 408. A cam 410 mounted on the knife carriage 406 engages the paper holder 404 to press the paper against the fixed blade 402 as the knife carriage is moved across the paper 14. In operation, the cut station 20 cuts individual sheets 25 of photographic ink jet print paper from the web 14. Prior to cutting, the paper is advanced by metering roller 22 until a sensor 412 detects the leading edge of the paper web 14. The paper web 14 is then accurately advanced a further distance by metering rollers 22 and then stopped while the paper is cut.

A back printer 26 is located between the metering rollers 16 and the metering rollers 22 for printing information onto the back of web 14. The back printer 26 is, for example a low resolution monochrome ink jet print head employing rapid drying ink. Alternatively, the back printer 26 can be an impact printer. The back printer 26 prints information such as order and frame number on the back side of the web 14.

A pair of transport rollers 28 are located after the cutter 24 for delivering the cut sheets 25 of photographic ink jet print paper to a vacuum belt transport. The vacuum belt transport includes a first section having a belt 30 and a vacuum plenum 33, and a second section having a belt 31 and two independently controllable vacuum plenums 34 and 35.

Figure 10:
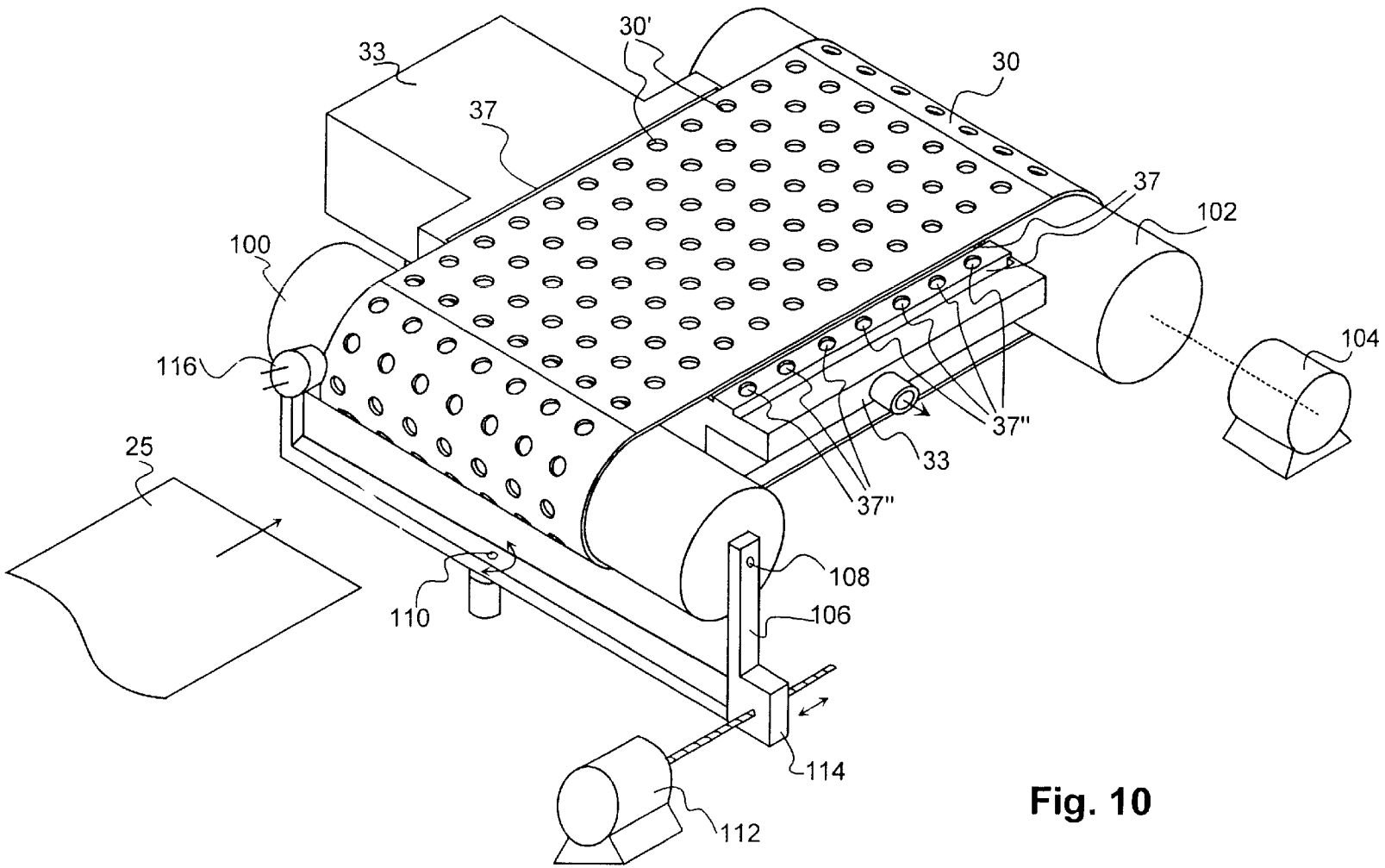
FIG. 10 is a schematic perspective view of the belt transport in the region of the print head according to the present invention.

As shown in FIG. 10, the vacuum belt 30 is not as wide as the cut paper sheet 25. The vacuum belt 30 is provided with a plurality of holes 30' for communicating the vacuum applied to plenum 33 for holding down the cut paper sheets. A plurality of holes (not shown) is also provided in the top of the plenum 33. The plenum 33 is wider than the cut paper sheet 25 and includes ink overspill collection grooves 37 on either side of the vacuum belt 30. The ink overspill collection grooves 37 are 2 mm wide and are provided with an absorbent material such as felt (not shown) for absorbing overspill from the print head as will be described below. Small holes 37" are provided between each groove 37 for communicating the vacuum in plenum 33 to hold down the edges of the paper sheet 25. One groove 37 is provided on the left side of the belt 30. For accommodating two different widths of paper, two grooves are provided on the right side of the belt 30. The paper sheet 25, regardless of size is always lined up with the left side of the belt 30. It will be understood that even more grooves may be provided to accommodate more than two different widths of paper.

The vacuum belt 30 is mounted on a pair of vacuum belt support and drive rollers 100, 102. Vacuum belt drive roller 102 is driven by a motor 104 to drive the vacuum belt 30. Roller 100 is mounted in a bracket 106 for rotation about its axis 108. Bracket 106 is mounted for rotation about an axis 110 perpendicular to the rotation of the roller axis 108 for controlling the tracking of belt 30 on the rollers 100 and 102. A belt bracket drive motor 112 is coupled to bracket 106, for example by a ball and lead screw drive 114 for rotating the bracket 106 slightly about axis 110, thereby causing belt 30 to move to the right or left on roller 100. A vacuum belt edge sensor 116, such as an light emitting diode/photosensor pair, is mounted for sensing the edge 118 of belt 30, to provide feedback to a controller (described below) for accurately controlling the position of belt 30 on the rollers 100 and 102.

Returning to FIG. 1, the first portion of the vacuum transport belt conveys the cut sheets 25 under the print head 36. The second portion of the vacuum transport belt includes a buffer zone controlled by vacuum plenum 34 to isolate the motion of the second vacuum transport belt from the first transport belt while a sheet is being printed, by turning the vacuum off in plenum 34 until the previous picture is printed. The length of the buffer zone is preferably as long as the longest expected print, e.g. 30 cm for a 10 cm wide panoramic print.

A full width, high resolution color ink jet print head 36 is located over the first vacuum belt transport 30 for printing a color photographic image onto the cut sheets 25 as they are transported under the print head by vacuum belt transport 30. The minimum distance from the transport roller 28 to the print head 36 is slightly greater than the maximum length of a cut sheet (e.g. 30 cm for a 10 cm wide panoramic print). The full width ink jet print head 36 is, for the example, a print head of the type shown in U.S. Pat. No. 5,812,162, issued Sept. 22, 1998 to Silverbrook. Preferably the print head is slightly wider than the cut sheets 25 (e.g. 12 cm wide) and has a printing resolution of 1200 dpi. The preferred ink jet print head 36 includes a plurality of print head components 38, 40, 42, 44, each supplied with a different color of ink, for example cyan, magenta, yellow, and black. The ink jet print head is capable of printing at a paper transport speed of 5 cm per second, or about 1000 prints per hour.

Figure 5:
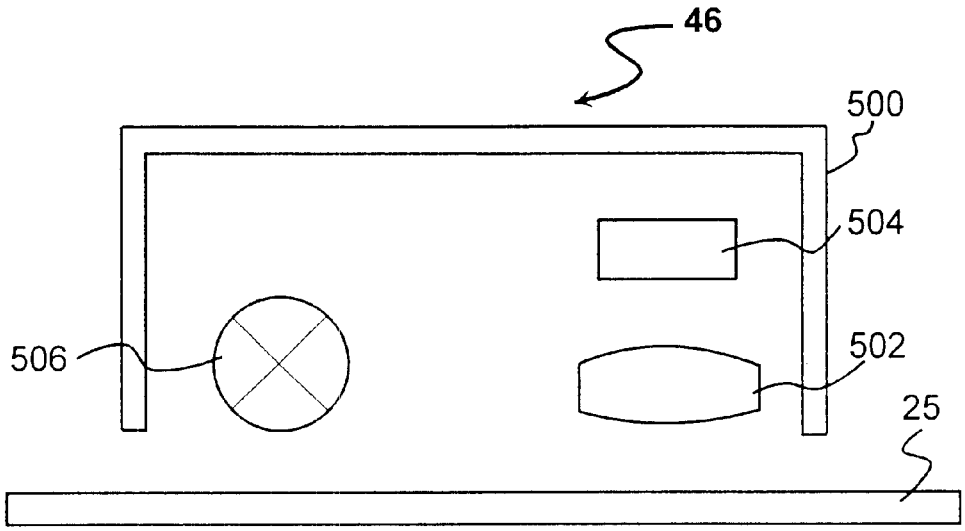
FIG. 5 is a schematic diagram showing the image sensor employed in the ink jet printer according to the present invention.

A image sensor 46, such as a photodiode sensor, is located in front of the ink jet print head 36 for sensing the leading edge of the cut paper sheets 25 as they are transported by vacuum belt transport 30 under the print head 36. Referring to FIG. 5, an example of a suitable sensor arrangement is shown. The image sensor 46 includes a housing 500, a lens 502 for focusing an image of the paper and transport belt onto a sensor module 504, and a light source 506 for illuminating the paper on the transport belt.

Figure 9:
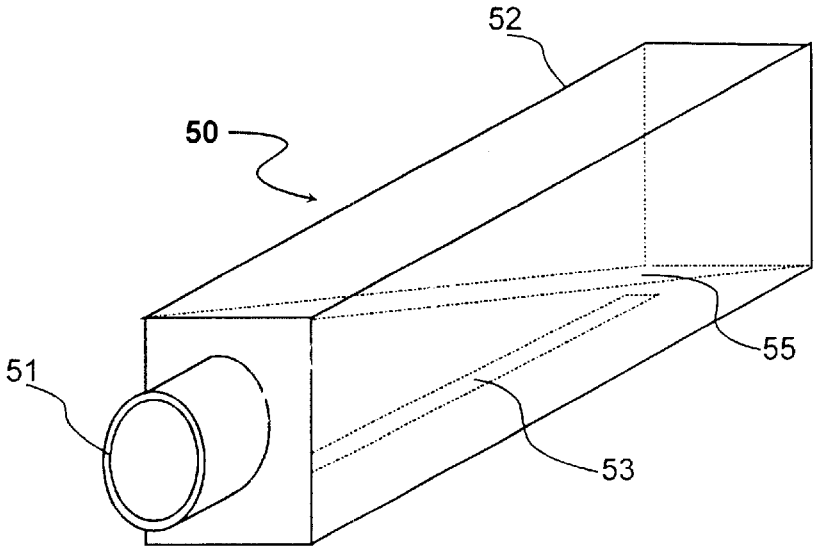
FIG. 9 is a perspective view of an air knife used in the paper drier of the present invention.

A paper dryer 48, including a plurality of air knives 50 is located over the second plenum 35 of belt transport 31 for drying the inked images before they reach the end of the belt transport. Referring to FIG. 9, the air knives 50 include a plenum 52 having an input 51 for heated-compressed air, an exit slot 53, and a baffle 55 for equalizing the pressure of the air along the exit slot 53. At a paper transport speed of 5 cm/second, and an air flow to the air knives of about 10 meters/sec, heated to not more than 80° C., prints printed with a water base ink can be dried in approximately 5 seconds. The paper dryer 48 is therefore about 25 cm long.

Figure 8:
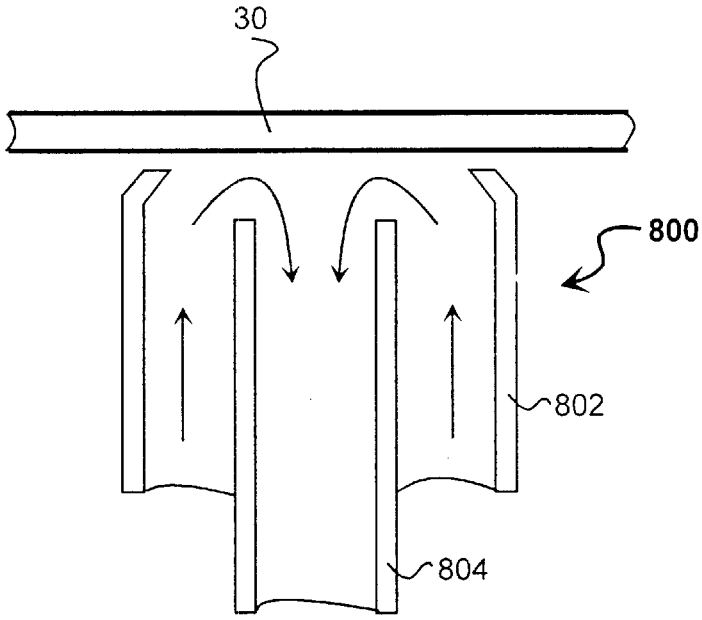
FIG. 8 is a detailed cross sectional view of the nozzle of a belt cleaner employed with the present invention.

A belt cleaning station 57 for cleaning paper dust and any overspilled ink from the transport belt 30 is provided on the side of the belt transport opposite to the ink jet print head 36. As shown in more detail in FIG. 8 the cleaning station comprises a cleaning head 800 that is as wide as the belt 30. The cleaning head 800 has an external channel 802 for delivering a flow of pressurized air to the surface of the belt 30 and an internal channel 804 for collecting the flow of air, along with any dust or debris dislodged from the belt, and delivering the collected air to a filter (not shown). The cleaning station is described in more detail in copending U.S. patent application Ser. No. 09/535,323 filed Mar. 27, 2000.

A second cutting station 20', similar to the cutting station described above with respect to FIG. 4 is located at the end of belt transport 31 for trimming the leading and trailing edges of the cut paper sheets 25 after they have been dried.

Control electronics 54, including a digital processor such as a micro-computer, is connected to the various components of the printer for controlling the operation of the printer 10. The operation of the printer 10, under control of control electronics 54, will now be described. The control electronics receives digital image data, back print data, and print order instructions from an input device such as a film scanning station, or a digital image processing station (not shown). During printing, the control electronics 54 commands the printer to meter the printing paper web 14 to the cutter 24 and print the back print information on the web 14 prior to the paper being cut.

The paper sheet 25, bearing the back print information, is then cut from the web 14 by cutter 24 and advanced to the vacuum belt transport 30. The image sensor 46 detects the leading edge of the cut sheet 25 as it enters the vacuum belt. Digital image data is supplied to the ink jet print head 36 by control electronics 54 to print the image slightly (about 1 mm) over the sides of the sheet 25 and slightly short of the leading and trailing edges of the sheet 25. In this way, overspill from the ink jet print head 36 onto the vacuum transport belt is avoided on the leading and trailing edges of the print and the slight overspill on the edges is collected by the overspill collection grooves 37 on the plenum 33. For bordered prints, the cut paper sheet 25 is cut to the finished size in cutting station 20. The control electronics 54 sizes the image for the smaller image area and centers the image on the paper. There is no need to trim the bordered print in the second cutting station 20'.

The sheets of printing paper are transported continuously past the ink jet print head 36. After being printed, the sheets pass through the print dryer 48, where the ink is dried, At the end of the vacuum transport belt 30, a sensor 20" in the cut station 20' senses the leading and trailing edge of the sheet and the control electronics 54 operates the second cut station 20' to trim the leading and trailing edges of the print where no ink was printed, thereby producing a perfect borderless print. The prints are then delivered to a finishing station (not shown) where they are assembled into customer order envelopes.

Figure 2:
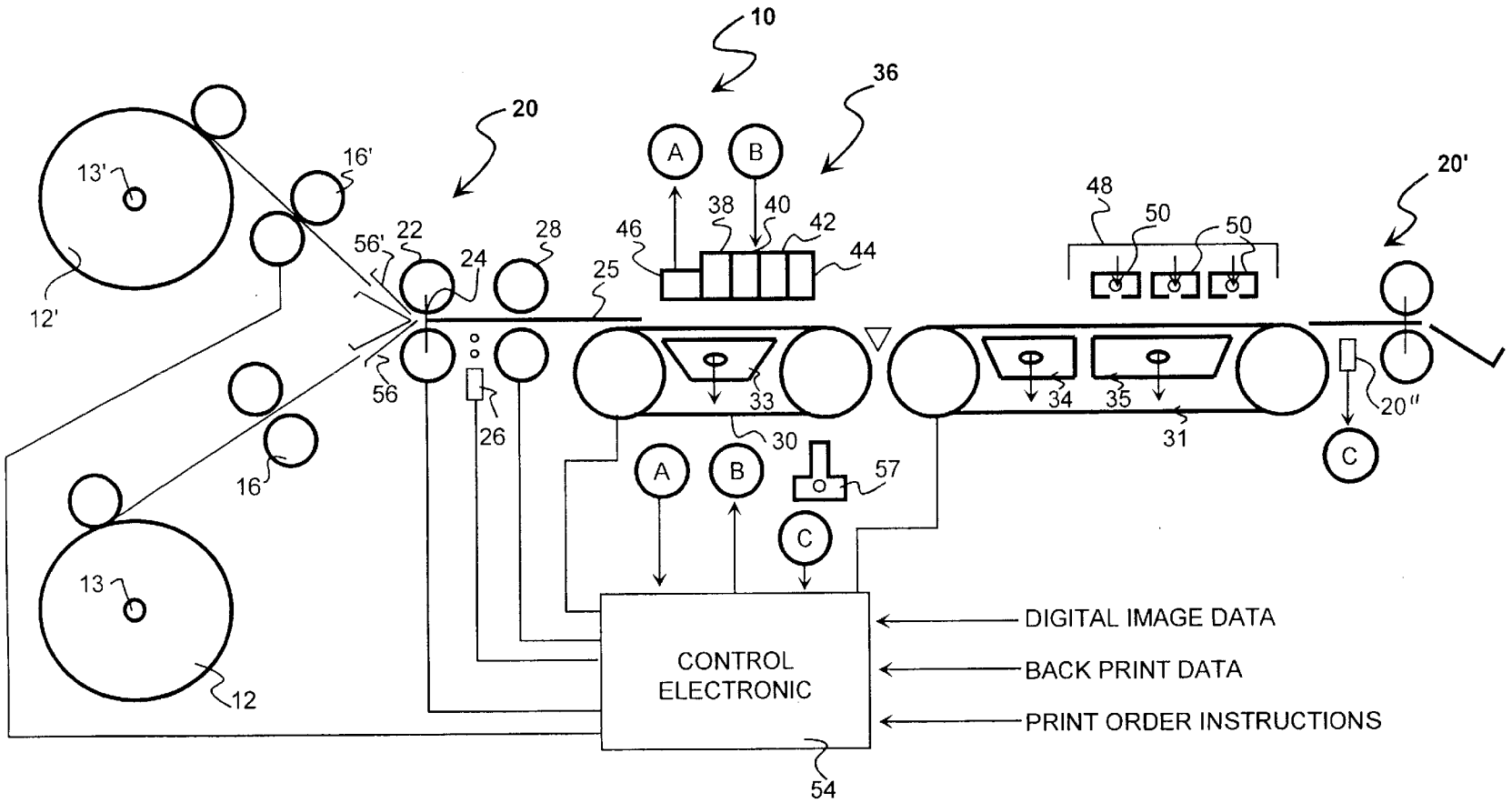
FIG. 2 is a schematic diagram of an alternative embodiment of the present invention.

Referring to FIG. 2, an alternative embodiment of the printer according to the present invention will be described. In order to provide more flexibility in paper sizes, the printer of FIG. 2 is provided with a second roll paper supply 12' for supplying a web 14' of paper that is narrower than the web 14 (e.g. 9 cm wide). The different sized paper webs 14 and 14' are selectively fed to cutter 24 under control of control electronics 54 depending upon the desired print size contained in the print order instructions. Thus, control electronics 54 provides a means for switching between paper supplies. Paper guides 56 and 56' are provided for guiding the paper metered by metering rollers 16 and 16' respectively into the metering rollers 22 of paper cutter 24. In this embodiment, the back printer 26 is located between the metering rollers 22 and the transport rollers 28. The control electronics 54 functions as described above to form a print mask from the signal supplied from image sensor 46 that is combined with the digital image data so that overspill onto the vacuum transport belt is avoided. The location of the overspill collection grooves 37 on the top of plenum 33 is chosen to accommodate the different sizes of print paper.

Figure 3:
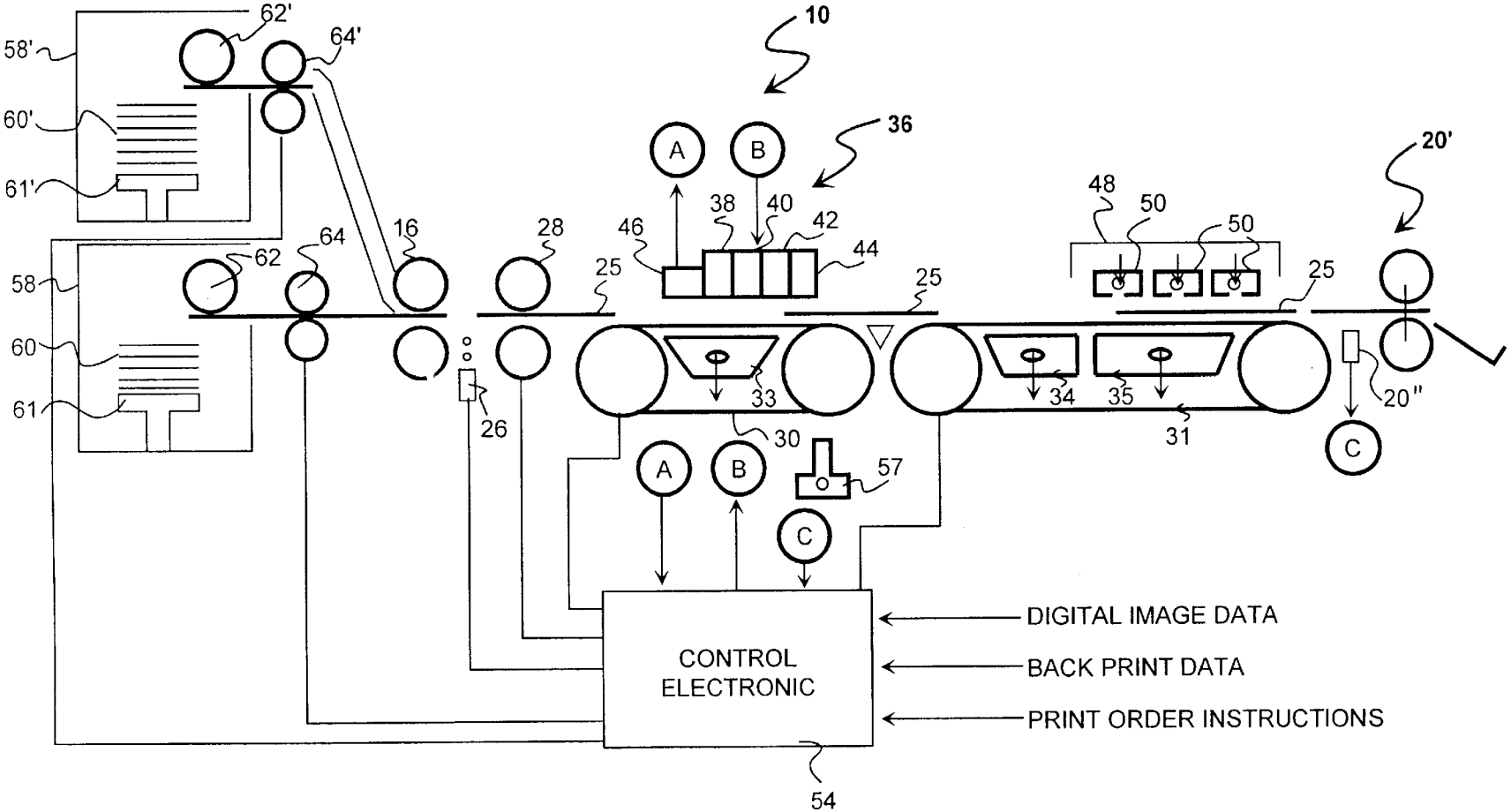
FIG. 3 is a schematic diagram of a further alternative embodiment of the present invention.

Referring to FIG. 3, a further alternative embodiment of an ink jet printer according to the present invention will be described. This embodiment, like that shown in FIG. 2, has two paper supplies 58 and 58', but in this case the paper supplies hold stacks of cut paper 60 and 60' having different sizes respectively. Picking rollers 62 and 62' deliver sheets from the tops of the stacks to paper transport rollers 64 and 64' respectively, and thence to paper metering rollers 16. The paper supplies can also have different lengths of paper of the same width for producing bordered and borderless prints. As described above, the bordered prints do not need to be trimmed in the second cutting station 20', and the cut paper sheets for bordered prints are therefore slightly shorter than the cut paper sheets for borderless prints.

Figure 6:
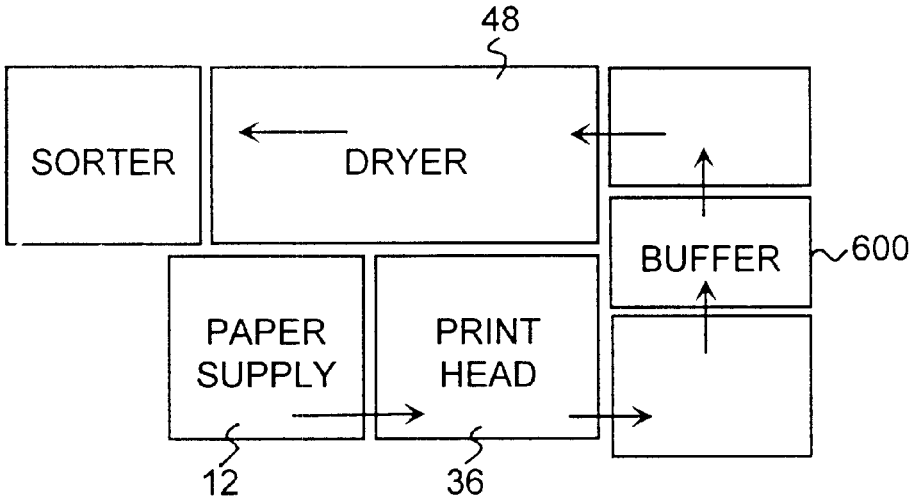
FIG. 6 is a schematic diagram illustrating the layout of an inkjet printer according to the present invention.
Figure 7:
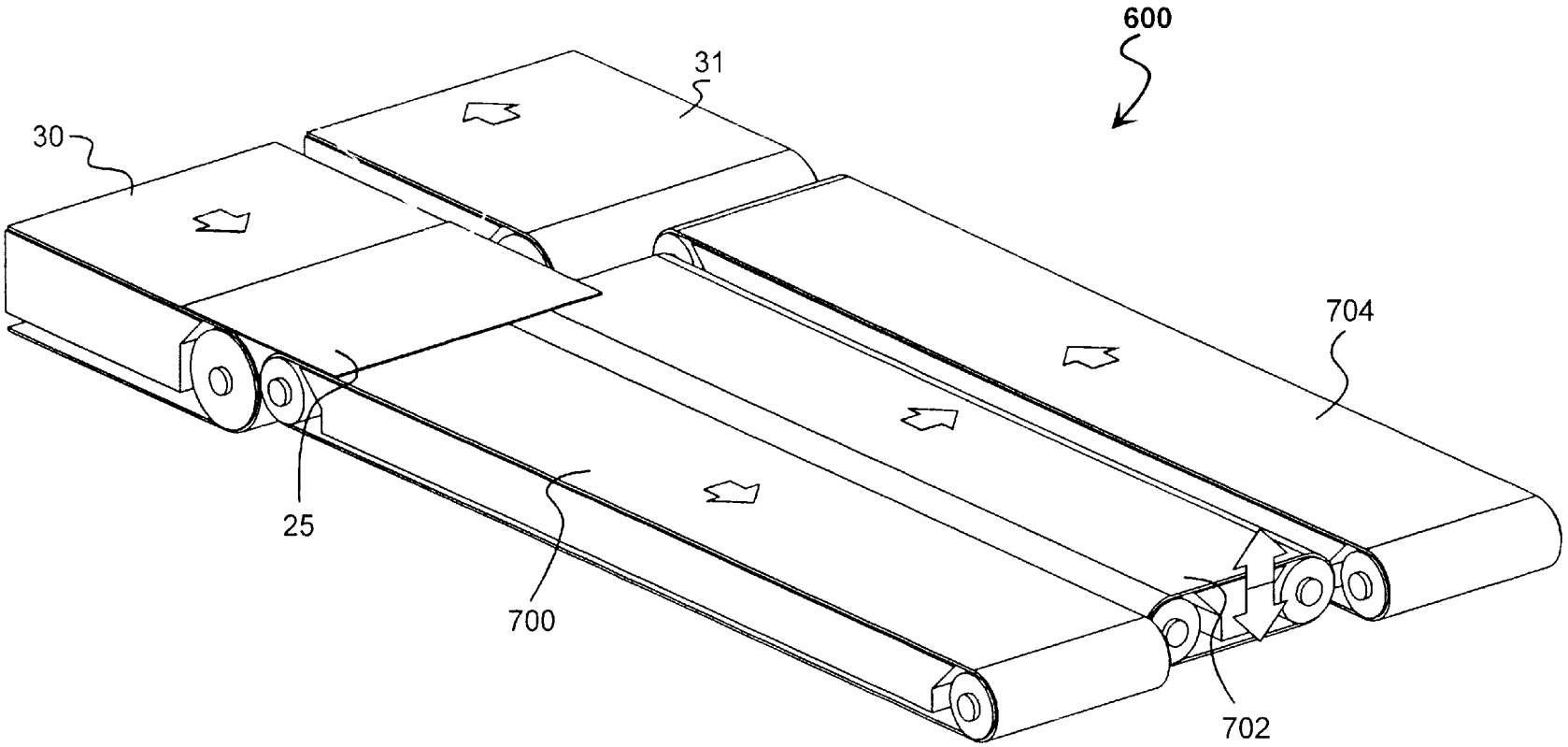
FIG. 7 is a perspective view of a buffer section employed with a printer having the layout shown in FIG. 6.

As described above, the ink jet printers according to the invention are arranged to transport the paper in a linear fashion from paper supply, through the printer and the dryer, to the output. This arrangement results in a long, thin printer. Referring to FIG. 6, a printer layout is shown where the printing and drying components are arranged in parallel, and a print buffer 600 is arranged between the print head 36 and the dryer 48. The print buffer 600 isolates the effects of the dryer 48 on the print head section of the paper transport and changes the direction of paper transport of the paper 360° to deliver the paper from the print head 36 to the dryer 48. Referring to FIG. 7, the buffer section 600 includes a first vacuum belt section 700 that is narrower than the smallest paper width (e.g. 7 cm for a minimum paper width of 9 cm), and extends in the same direction as the belt 30. A second section 702 extends in a direction perpendicular to the first section 700 for transporting the cut sheet 25 to a third section 704 that delivers the cut sheet to the vacuum belt 31 under dryer 48. As described above, the belt transports are vacuum belt transports. Alternatively, electrostatic belt transports can be used for the portions of the transport under the print head and the dryer. An example of an electrostatic transport useful with the present invention is shown in European published application 0 887 196 A2.

| PARTS LIST | |
|---|---|
| 10 | ink jet printer |
| 12, 12' | roll paper supply |
| 13, 13' | holders |
| 14, 14' | web |
| 16, 16' | metering roller |
| 20, 20' | cut station |
| 20" | sensor |
| 22 | metering rollers |
| 24 | cutter |
| 25 | cut sheet of print paper |
| 26 | back printer |
| 28 | transport rollers |
| 30 | first vacuum belt |
| 30' | vacuum belt holes |
| 31 | second vacuum belt |
| 33 | vacuum plenum |
| 34 | vacuum plenum |
| 35 | vacuum plenum |
| 36 | ink jet print head |
| 37 | ink overspill collection grooves |
| 37" | holes |
| 38 | print head component |
| 40 | print head component |
| 42 | print head component |
| 44 | print head component |
| 46 | image sensor (linear) |
| 48 | paper dryer |
| 50 | air knife |
| 51 | air input |
| 52 | plenum |
| 53 | air exit slot |

-continued

| PARTS LIST | |
|---|---|
| 54 | control electronics |
| 55 | baffle |
| 56, 56' | paper guide |
| 57 | belt cleaning station |
| 58, 58' | paper supply |
| 60, 60' | cut paper stack |
| 61, 61' | supports |
| 62, 62' | picker |
| 64, 64' | transport roller |
| 100 | vacuum belt support roller |
| 102 | vacuum belt drive roller |
| 104 | vacuum belt drive motor |
| 106 | roller mounting bracket |
| 108 | roller rotation axis |
| 110 | bracket rotation axis |
| 112 | belt bracket drive motor |
| 114 | ball and lead screw drive |
| 116 | vacuum belt edge sensor |
| 118 | edge of vacuum belt |
| 400 | circular knife |
| 402 | fixed blade |
| 404 | paper holder |
| 406 | knife carriage |
| 408 | shaft |
| 410 | cam |
| 412 | sensor |
| 500 | housing |
| 502 | lens |
| 504 | sensor module |
| 506 | light source |
| 600 | print buffer |
| 700 | first vacuum belt section |
| 702 | second vacuum belt section |
| 704 | third vacuum belt section |
| 800 | cleaning head |
| 802 | external channel |
| 804 | internal channel |

What is claimed is:

1. An ink jet printer for making photographic prints, comprising:

a) at least one paper supply for holding a supply of print paper;

b) a sheet paper transport belt arranged to receive sheets of print paper from the at least one paper supply and transport the sheets through the printer;

c) a back printer located between the at least one paper supply and the sheet paper transport belt for applying back prints to the print paper;

d) a full print width color ink jet print head located over a first portion of the sheet paper transport belt for printing an image on a paper sheet;

e) a paper support located under the ink jet print head, the paper support including grooves at the sides of the transport belt for collecting overspilled ink from the in jet print head;

f) an image sensor located in front of the ink jet print head for detecting the leading edge of the cut paper sheet being transported under the print head;

g) a controller responsive to the image sensor for controlling the print head to print an image that is slightly shorter and slightly wider than the paper sheet, thereby preventing overspill printing on the leading and trailing edges of the sheet, while allowing slight overspill printing on the sides of the sheet into the overspill collection grooves;

h) a paper dryer located over a second portion of the sheet paper transport belt, the paper dryer including a source of flowing air for drying the image on the paper sheet; and i) a sheet trimming station located at the end of the sheet paper transport belt for trimming the leading and trailing edges of a sheet after drying.

2. The ink jet printer claimed in claim 1, having more than one paper supply for holding print paper of different widths, and means for switching between the different paper supplies for changing the size of the prints being printed by the ink jet printer.

3. The ink jet printer claimed in claim 1, wherein one of the paper supplies is a roll paper supply comprising:

a) a holder for receiving a roll of print paper;

b) a cutter for cutting the paper from the paper supply into sheets, and c) a paper transport arranged between the roll paper supply and the cutter.

4. The ink jet printer claimed in claim 1, wherein one of the paper supplies is a sheet paper supply comprising:

a) a support for holding a stack of paper sheets, and b) a picker for picking a paper sheet off of the stack and delivering it to the sheet paper transport belt.

5. The ink jet printer claimed in claim 1, wherein the back printer comprises an ink jet print head.

6. The ink jet printer claimed in claim 1, wherein the sheet trimming station includes a sensor for sensing the leading and trailing edges of the sheet and a trimming knife responsive to the sensor for trimming the leading and trailing edges of the sheet.

7. The ink jet printer claimed in claim 1, wherein the sheet paper transport belt is a vacuum belt transport including a vacuum belt and a vacuum plenum, and wherein the paper support under the printing head is the top of the plenum.

8. The ink jet printer claimed in claim 1, wherein the image sensor is a linear CCD image sensor.

9. The ink jet printer claimed in claim 1, wherein the sheet paper transport belt includes a print buffer section located after the print head.

10. The ink jet printer claimed in claim 9, wherein the print buffer section changes the direction of paper transport between the print head and the drying section.

11. The ink jet printer claimed in claim 1, further comprising: a cleaning station located on the opposite side of the sheet paper transport belt from the ink jet print head for cleaning paper dust and overspill ink from the belt transport.

12. The ink jet printer claimed in claim 1, wherein the source of flowing air is an air knife having a plenum, an input for receiving a flow of air, an exit slot for delivering a flow of air, and a baffle arranged in the plenum to equalize the flow of air from the exit slot.

13. The ink jet printer claimed in claim 1, wherein the overspill collection grooves contain an ink absorbent material.

* * * * *